US010545521B2

(12) United States Patent
Ramos et al.

(10) Patent No.: US 10,545,521 B2
(45) Date of Patent: Jan. 28, 2020

(54) LINEAR REGULATOR WITH IMPROVED POWER SUPPLY REJECTION RATIO

(71) Applicant: Dialog Semiconductor (UK) Limited, London (GB)

(72) Inventors: Carlos Zamarreno Ramos, Munich (DE); Ambreesh Bhattad, Swindon (GB); Frank Kronmueller, Neudenau (DE)

(73) Assignee: Dialog Semiconductor (UK) Limited, London (GB)

( * ) Notice: Subject to any disclaimer, the term of this patent is extended or adjusted under 35 U.S.C. 154(b) by 403 days.

(21) Appl. No.: 15/232,408

(22) Filed: Aug. 9, 2016

(65) Prior Publication Data

US 2017/0090495 A1 Mar. 30, 2017

(30) Foreign Application Priority Data

Sep. 28, 2015 (DE) ..... 10 2015 218 656

(51) Int. Cl.
*G05F 1/575* (2006.01)

(52) U.S. Cl.
CPC ..... *G05F 1/575* (2013.01)

(58) Field of Classification Search
CPC ..... G05F 1/575
See application file for complete search history.

(56) References Cited

U.S. PATENT DOCUMENTS 8,648,580 B2 * 2/2014 Wong ..... G05F 1/575 323/265
2005/0225398 A1 10/2005 Chien
2012/0212199 A1 * 8/2012 Amer ..... G05F 1/575 323/280
2013/0147447 A1 * 6/2013 Liu ..... G05F 1/575 323/273
2013/0297665 A1 * 11/2013 Nikitin ..... G06G 7/1928 708/300
2014/0306676 A1 10/2014 Hu et al.
2015/0061772 A1 3/2015 Bhattad

OTHER PUBLICATIONS

Fernandes, Pedro Miguel Antunes; "High PSRR Low Drop-out Voltage Regulator (LDO)"; Apr. 2009; Universidade Technica de Lisboa; pp. 18-32 (Year: 2009).*

(Continued)

*Primary Examiner* — Yusef A Ahmed
*Assistant Examiner* — Shahzeb K Ahmad
(74) *Attorney, Agent, or Firm* — Saile Ackerman LLC; Stephen B. Ackerman

(57) ABSTRACT

A linear regulator with a pass device having a first terminal, a second terminal and a drive terminal is presented. The first terminal of the pass device is coupled with the supply voltage of the linear regulator. The second terminal of the pass device is coupled with the output of the linear regulator. A driver stage is coupled with the supply voltage of the linear regulator, and the drive terminal of the pass device drives the pass device with a driving voltage. A compensating circuit compensates for a change in a voltage difference between the drive terminal of the pass device and the supply voltage of the linear regulator.

22 Claims, 6 Drawing Sheets

(56) References Cited

OTHER PUBLICATIONS

German Office Action, File No. 10 2015 218 656.3, Applicant Dialog Semiconductor (UK) Limited, dated May 2, 2016, 7 pgs, and English languate translation, 9 pgs.
Texas Instruments Data Sheet, TPS7A8101 Low-Noise, Wide Bandwidth, High PSRR, Low-Dropout 1-A Linear Regulator, SBVS179B, Dec. 2011, 28 pages.
Texas Instruments Data Sheet, LP38798 800-mA Ultra-Low-Noise, High-PSRR LDO, SNOSCT6F, Mar. 2013, 30 pages.
Analog Devices Data Sheet, 40 V, 200 mA, Low Noise,CMOS LDO Linear Regulator, Sep. 2014, ADP7142, pp. 1-23.
Linear Technology Data Sheet, 20V, 200mA, Ultralow Noise, Ultrahigh PSRR RF Linear Regulator, LT3042, © Analog Devices, Inc. 2017, pp. 1-30.

* cited by examiner

LINEAR REGULATOR WITH IMPROVED POWER SUPPLY REJECTION RATIO

TECHNICAL FIELD

The present document relates to linear regulators and in particular to low dropout regulators (LDOs) with enhanced power supply rejection ratio (PSRR) at higher frequencies.

BACKGROUND

Linear regulators or low-dropout (LDO) regulators are widely used in a variety of systems to provide a regulated voltage to other circuits in the system. In general, such regulators are required to provide and maintain a constant voltage across a wide variety of loads and/or operating frequencies in electrical applications. In particular, it is desirable to provide a stable and accurately regulated output voltage from an unregulated and many times noisy input voltage, i.e. typically the supply voltage of the regulator. The ability of a regulator to be immune to the noise injected in the input voltage is usually called PSRR (Power Supply Rejection Ratio).

PSRR describes the effectiveness of a regulator to eliminate output ripple caused by input/supply variations. Mathematically, PSRR is the reverse gain of the output ripple over the input ripple at a particular frequency. In general, it can also be defined by the amount of noise from a power supply that the regulator can reject, in other words, by measuring the amount of noise present on the power supply to the regulator which is transmitted to the output of the regulator. In case of a low amount of noise transmission, high PSRR is obtained, whereas a high amount of noise transmission leads to low PSRR.

An ideal linear regulator should provide a very high PSRR value across a wide variety of loads and/or operating frequencies. In particular, high PSRR values are desirable over the frequency range that is critical to the linear regulator, typically 10 Hz to 10 MHz. However, as a signal injected from devices supplied by the linear regulator may cause PSRR degradation at high frequencies, it is difficult to achieve high PSRR values across a wide range of operating frequencies.

SUMMARY

There is a need to improve PSRR of linear regulators over a higher frequency range. The present document discloses a linear regulator and a corresponding method to improve PSRR degradation at specific higher frequencies. In view of this need, the present document proposes a linear regulator and a corresponding method having the features of the respective independent claims for improving PSRR of the linear regulator at higher frequencies.

According to a broad aspect of the disclosure, a linear regulator is provided. The linear regulator may be coupled with a supply voltage. The linear regulator may comprise a pass device to provide a load current to a load which may be coupled with the output of the linear regulator. The pass device may have a first terminal, a second terminal and a drive terminal. The first terminal of the pass device may be coupled with the supply voltage of the linear regulator and the second terminal of the pass device may be coupled with the output of the linear regulator. In an embodiment, the pass device may comprise a PMOS transistor.

According to the disclosure, the linear regulator may comprise a driver stage. In embodiments, the driver stage may comprise a buffer stage. The driver stage may be coupled with the supply voltage of the linear regulator and the drive terminal of the pass device to drive the pass device with a driving voltage. The linear regulator may further comprise a compensating circuit. It is noted that the compensating circuit may be configured to compensate for a change in a voltage difference. The voltage difference may be a voltage difference between the drive terminal of the pass device and the supply voltage of the linear regulator.

In particular, the driver stage may comprise a drive transistor and the compensating circuit may comprise at least one further drive transistor. In an embodiment, the drive transistor of the driver stage may be in a current mirror configuration with the pass device. In an embodiment, the drive transistor of the driver stage may be arranged in parallel with the at least one further drive transistor of the compensating circuit. Preferably, each of the drive transistor and the at least one further drive transistor may be coupled with the supply voltage of the linear regulator.

For example, each of the drive transistor and the at least one further drive transistor may comprise a first terminal and a drive terminal. In a preferred embodiment, the first terminal of each of the drive transistor and the at least one further drive transistor may be coupled with the supply voltage of the linear regulator. Moreover, the drive terminal of the drive transistor may be coupled with the drive terminal of the pass device. It is noted that the drive terminal of the drive transistor may provide the driving voltage to drive the pass device.

According to the disclosure, the compensating circuit may further comprise at least one low-pass filter (LPF). In embodiments, the at least one LPF may be coupled between the drive transistor and the at least one further drive transistor. The at least one LPF may be configured to filter the driving voltage from the drive transistor of the driver stage for the at least one further drive transistor of the compensating circuit. Especially, the at least one LPF may correspond to the at least one further drive transistor.

Furthermore, each of the at least one LPF may comprise an input and an output. The input of each LPF may be coupled to the drive terminal of the drive transistor. The output of each LPF may be coupled to the drive terminal of a corresponding further drive transistor of the at least one further drive transistor. As such, the driving voltage from the drive terminal of the drive transistor may be filtered for the at least one further drive transistor. In embodiments, the at least one LPF may have a transfer function with poles or, alternatively, some of the at least one LPF may have a transfer function with poles and zeros. Typically, each LPF has a cut-off frequency in its transfer function. Accordingly, the transfer function with a proper distribution of poles and zeros may be provided to filter the driving voltage for the corresponding further drive transistor. In particular, the cut-off frequency (and correspondingly, the poles and zeros) may be designed so as to extend to higher frequencies the region where the ratio between driving voltage Pgate of the driver stage and the supply voltage Vin is constant.

As a result, the change in a voltage difference between the drive terminal of the pass device and the supply voltage of the linear regulator can be compensated through the contribution of the at least one further drive transistor of the compensating circuit. The voltage difference between the drive terminal of the pass device and the supply voltage of the linear regulator thus remains constant for a wider range of frequency, thereby reducing injections of ripples and improving the power supply rejection ratio (PSRR).

According to the disclosure, the compensating circuit may comprise a plurality of further drive transistors. Therefore, a plurality of low-pass filters (LPFs) may be applied accordingly. More specifically, the compensating circuit may comprise N LPFs and N corresponding further drive transistors. N denoted herein may be an arbitrary integer. In general, N may be associated with a number of LPF cut-off frequencies at which the change in the voltage difference between the drive terminal of the pass device and the supply voltage of the linear regulator is compensated. In embodiments, N may correspond to a number of LPF cut-off frequencies at which the change in the voltage difference between the drive terminal of the pass device and the supply voltage of the linear regulator is compensated.

According to the disclosure, the driver stage may further comprise another transistor. Preferably, each of the drive transistor and the at least one further drive transistor may be coupled with the another transistor. For example, each of the drive transistor and the at least one further drive transistor may further comprise a second terminal. In a preferred embodiment, the second terminal of each of the drive transistor and the at least one further drive transistor may be coupled with the another transistor.

In an embodiment, the another transistor may comprise an NMOS transistor and the drive transistor may comprise a PMOS transistor to form the driver stage to drive the pass device. If the drive transistor comprises a PMOS transistor, the first terminal of the drive transistor may comprise a source terminal of the PMOS transistor and the drive terminal of the drive transistor may comprise a gate terminal of the PMOS transistor. Therefore, the voltage difference between the drive terminal of the pass device and the supply voltage of the linear regulator may be associated with a voltage difference between the gate and the source terminal of the PMOS transistor of the driver stage. Moreover, the second terminal of the drive transistor may be coupled with the source of the another transistor.

In an embodiment, the at least one further drive transistor may comprise at least one further PMOS transistor arranged in the compensating circuit. If the at least one further drive transistor comprises at least one further PMOS transistor, the first terminal of the at least one further drive transistor may comprise a source terminal of the at least one further PMOS transistor and the drive terminal of the at least one further drive transistor may comprise a gate terminal of the at least one further PMOS transistor. The source terminal of the at least one further PMOS transistor may be coupled with the supply voltage of the linear regulator and the second terminal of the at least one further PMOS transistor may be coupled with the another transistor of the driver stage, e.g. the source of the another transistor, according to the embodiment.

In one embodiment, the linear regulator may further comprise a first amplifier stage, a second amplifier stage and a capacitor. The second amplifier stage may be coupled between the first amplifier stage and the driver stage. The capacitor may be coupled between the first amplifier stage and the output of the linear regulator to split poles for increasing stability.

The proposed linear regulator thus allows extending the frequency range for which the voltage difference between the drive terminal of the pass device and the supply voltage of the linear regulator remains constant. It is appreciated that PSRR degradation can be mitigated at specific frequencies, in particular at the high frequency range, by compensating the voltage difference between the drive terminal of the pass device and the supply voltage of the linear regulator with the above mentioned compensating circuit.

According to another aspect, a method of operating a linear regulator is proposed. The linear regulator may be configured as disclosed above and may comprise a pass device and a driver stage. In embodiments, the driver stage may comprise a buffer stage. The driver stage may comprise a driving branch and the driving branch may be configured to drive the pass device with a driving voltage through a drive terminal. In embodiments, the driving branch may be in a current mirror configuration with the pass device.

It is noted that the linear regulator may further comprise a compensating circuit. The compensating circuit may comprise at least one further driving branch. In particular, the at least one further driving branch may be configured to compensate for a change in a voltage difference between the drive terminal and the supply voltage of the linear regulator. In embodiments, each of the driving branch and the at least one further branch may comprise a transistor.

According to the disclosure, the method may comprise applying the supply voltage of the linear regulator to the at least one further driving branch. Furthermore, the method may comprise low-pass filtering the driving voltage for the at least one further driving branch. In embodiments, low-pass filtering the driving voltage may be based on a transfer function with poles. In one embodiment, low-pass filtering the driving voltage may be based on a transfer function with poles and zeros. The method may further comprise providing the at least one further driving branch with a gate voltage based on the filtered driving voltage in order to operate the at least one further driving branch.

In embodiments, a number of the further driving branches may be associated with a number of frequencies at which the change in the voltage difference between the drive terminal of the pass device and the supply voltage of the linear regulator is compensated. In one embodiment, a number of the further driving branches may correspond to a number of frequencies at which the change in the voltage difference between the drive terminal of the pass device and the supply voltage of the linear regulator is compensated.

Furthermore, the method may comprise obtaining a first current and at least one second current. The at least one second current may correspond to the at least one further branch. In particular, the first current may be provided by the driving branch, and the at least one second current may be provided by the corresponding further driving branch. The method may further comprise combining the first current and the at least one second current in order to drive the pass device with the driving voltage.

It is appreciated that the change in a voltage difference between the drive terminal of the pass device and the supply voltage of the linear regulator caused by injected ripples of high frequencies can be compensated with the joint contribution of the driving branch and the at least one further driving branch. Consequently, the voltage difference between the drive terminal of the pass device and the supply voltage of the linear regulator can be kept constant in the presence of injected ripples for a larger range of frequencies, thereby reducing the impact of injected ripples and improving the PSRR of the linear regulator.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the terms "couple", "coupled", "connect", and "connected" refer to elements being in electrical communication with each other, whether directly connected e.g., via wires, or in some other manner.

BRIEF DESCRIPTION OF THE DRAWINGS

The application is explained below in an exemplary manner with reference to the accompanying drawings, wherein

FIG. 6(*b*) shows diagrams of gate voltage (top) and drain current (bottom) of the N further drive transistors according to the embodiment of FIG. 6(*a*)

DESCRIPTION

Figure 1:
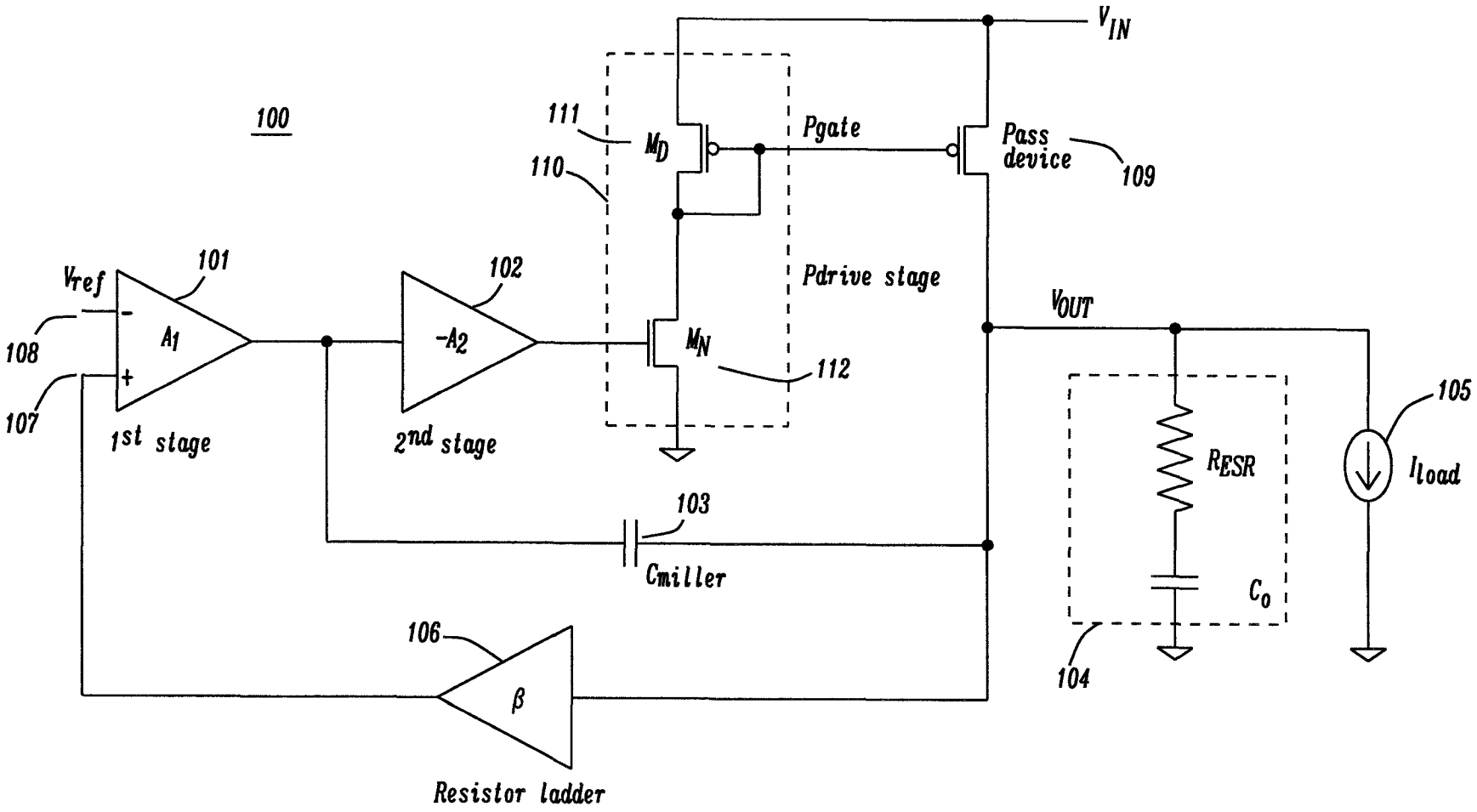
FIG. 1 shows a circuit diagram of a typical linear regulator.

FIG. 1 shows a diagram of a typical linear regulator with a pass device. The linear regulator 100 comprises a first amplifier stage 101, a second amplifier stage 102, a driver stage 110, and a pass device 109. The first amplifier stage 101 is a differential amplifier stage or differential amplifier (also referred to as error amplifier) with a reference input 108 coupled to a reference voltage $V_{ref}$ and a feedback input 107 coupled to the regulator output voltage $V_{out}$, via a feedback factor 106. The feedback factor 106 is normally implemented with a resistor divider (not shown) and determines a fraction of the output voltage $V_{out}$ to be provided at the feedback input 107 of the first amplifier stage 101. The reference input 108 of the first amplifier stage 101 receives a stable voltage reference $V_{ref}$, and the drive voltage to the second amplifier stage 102 changes by a feedback mechanism, i.e. a main feedback loop, in case that the output voltage $V_{out}$ changes relative to the reference voltage $V_{ref}$, so that a constant output voltage $V_{out}$ can be maintained. The second amplifier stage 102 may be an inverter and may comprise a plurality of substages.

At the output of the linear regulator, a load 105 is coupled in parallel with an output capacitor 104 (also referred to as output capacitor or stabilization capacitor or bypass capacitor) which may comprise an equivalent series resistance $R_{ESR}$ and a capacitance $C_0$. The load 105 draws a load current $I_{load}$ from the regulator. The output capacitor 104 is used to stabilize the output voltage $V_{out}$ subject to a change of the load 105, in particular subject to a transient of the load current $I_{load}$. If the linear regulator 100 is loaded with a varying current, the bandwidth of the pass device 109 across different operating conditions changes. The linear regulator 100 may be a supply feedback Miller compensated linear regulator and may additionally comprise a Miller capacitor 103 having a capacitance $C_{miller}$ coupled between the output of the linear regulator 100 and the node between the first amplifier stage 101 and the second amplifier stage 102. The use of Miller compensation capacitor can provide the pole splitting capability needed to get a stable system across different load conditions.

The pass device 109 is driven with the driver stage 110 which is a buffer stage. The driver stage 110 is formed by a common source NMOS transistor MN 112 and a drive transistor $M_D$ 111 that is a PMOS transistor in diode configuration. In such a configuration, the driver stage 110 can be regarded as a $P_{drive}$ stage since the drive transistor $M_D$ 111 is a PMOS transistor. According to FIG. 1, the gate of drive transistor 111 is connected with the gate of the pass device 109 which is also a PMOS transistor, both transistors forming a current mirror. The driver stage 110 provides low output impedance to drive the relatively large load presented to the pass device 109. Furthermore, the current biasing this buffer is proportional to the load current $I_{load}$, depending on the ratio between the sizes of the pass device 109 and the drive transistor $M_D$ 111.

Due to the low output impedance of the driver stage 110 (the buffer $P_{drive}$ stage), good power supply rejection ratio (PSRR) can be provided. In other words, any alternating current (AC) signals coupled into the input supply signal of the linear regulator $V_{IN}$ will be seen with the same magnitude at the gate terminal of the pass device 109 (the node $P_{gate}$), keeping the voltage difference between the gate and the source terminal of the pass device 109 $V_{gs}$ constant across a large range of frequencies. However, this is no longer true when the driver stage 110 loses bandwidth due to a heavy capacitive load and it is no longer able to keep the $V_{gs}$ constant. This leads to a degradation of the PSRR at high frequencies due to a signal injected by the pass device transconductance.

A problem with this prior art linear regulator circuit is that AC signals or ripples of higher frequencies increase the injection of the drive transistor $M_D$ 111 from the input, which results in a $V_{gs}$ drop at high frequencies. As a consequence, PSRR is degraded, indicating that the ability of the linear regulator to be immune to the noise injected in the input voltage is deteriorated. In order to improve PSRR of linear regulators over a higher frequency range, the present document discloses a circuitry for a linear regulator to compensate the AC injections and keep the $V_{gs}$ constant across frequency.

Figure 2:
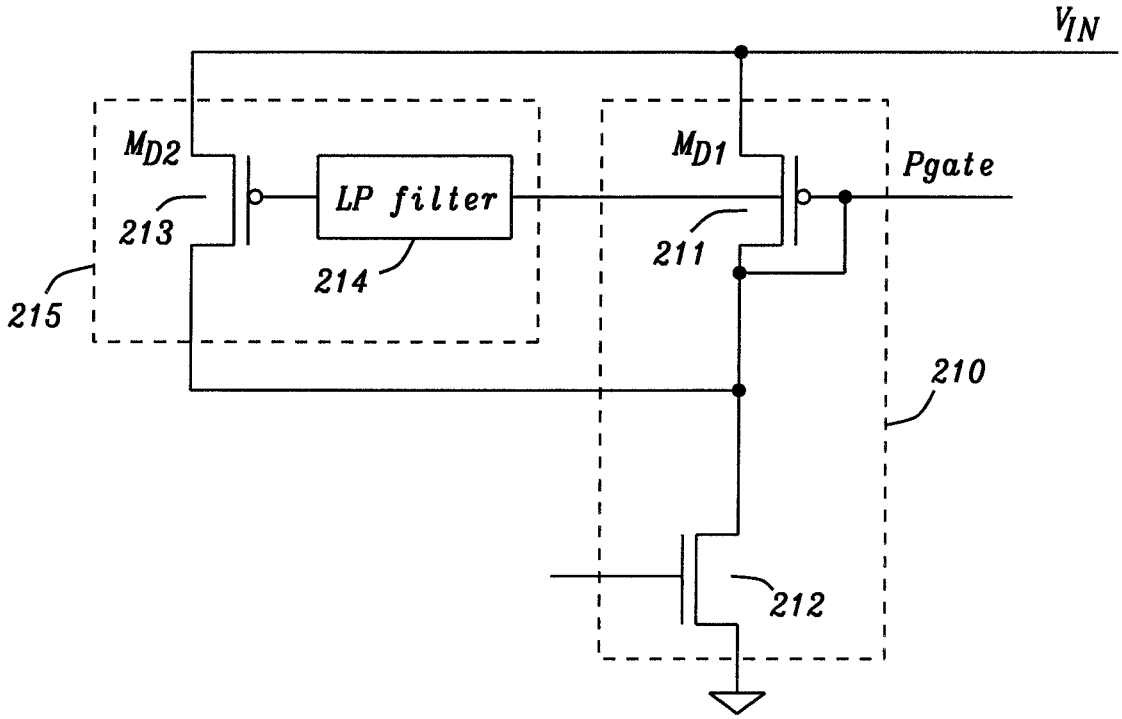
FIG. 2 shows a schematic implementation of a driving circuitry for a linear regulator according to an embodiment of the disclosure.

FIG. 2 shows a schematic implementation of a driving circuitry for a linear regulator according to an embodiment of the disclosure. The linear regulator comprises a driver stage 210 which may be used for the same purpose as the driver stage 110 in FIG. 1 that is coupled with the PMOS pass device 109 having a first terminal coupled with the supply voltage of the linear regulator $V_{IN}$, a second terminal coupled with the output of the linear regulator 100 and a drive terminal which is the gate of the PMOS pass device. Similar to the driver stage 110, the driver stage 210 comprises a common source NMOS transistor 212 and a drive transistor $M_{D1}$ 211 that is a PMOS transistor in diode configuration. The driver stage 210 is coupled with the supply voltage of the linear regulator $V_{IN}$ and the drive terminal of the PMOS pass device 109 of FIG. 1 to drive the PMOS pass device 109. In the embodiment, the gate of drive transistor $M_{D1}$ 211 is connected with the gate of the PMOS pass device 109 and provides the driving voltage ($P_{gate}$) to drive the PMOS pass device 109. The drive transistor $M_{D1}$ 211 is thus in a current mirror configuration with the PMOS pass device 109 and this configuration can be regarded as a P-type drive for a linear regulator.

According to the embodiment, the linear regulator further comprises a compensating circuit 215 which comprises a further drive transistor $M_{D2}$ 213 and a low-pass filter (LPF) 214. In this configuration, the further drive transistor $M_{D2}$ 213 is also a PMOS transistor and is arranged in parallel with the drive transistor $M_{D1}$ 211. That is, the source of the drive transistor $M_{D1}$ 211 and the source of the further drive transistor $M_{D2}$ 213 are both coupled to the supply voltage of the linear regulator $V_{IN}$, and the drain of the drive transistor $M_{D1}$ 211 and the drain of the further drive transistor $M_{D2}$ 213 are both coupled to the common source NMOS transistor 212, e.g. to the source of the NMOS transistor 212. Furthermore, the LPF 214 is coupled between the drive transistor $M_{D1}$ 211 and the further drive transistor $M_{D2}$ 213. More specifically, the input of the LPF 214 is coupled to the gate of the drive transistor $M_{D1}$ 211, and the output of the LPF 214 is coupled to the gate of the further drive transistor $M_{D2}$ 213. In fact, the diode connected device of the drive transistor $M_D$ 111 of FIG. 1 is split into two parts, i.e. $M_{D1}$ 211 and $M_{D2}$ 213, and the LPF 214 is placed to generate the gate voltage of $M_{D2}$ 213 from $M_{D1}$ 211.

At low frequencies, both voltages at the gate of $M_{D2}$ 213 and $M_{D1}$ 211 may be the same and there is no effect caused by splitting the drive transistor $M_D$ 111 of FIG. 1 into $M_{D1}$ 211 and $M_{D2}$ 213. When the cut-off frequency of the filter is hit, i.e. the frequency of the AC signals coupled into the input supply of the linear regulator $V_{IN}$ reaches the cut-off frequency of the filter, the gate voltage of $M_{D2}$ may be attenuated, causing the injection of $M_{D2}$ to be amplified over frequency (AC-wise) and phase to be shifted due to the filter. As a consequence, the currents resulting from two different $V_{gs}$ across frequency, $I_{MD1}$ and $I_{MD2}$, are summed up and they may partially cancel each other, keeping the driving voltage $P_{gate}$ constant over frequency (AC wise) for a larger range of frequencies, i.e. to higher frequencies above the cut-off frequency of the filter.

Figure 3:
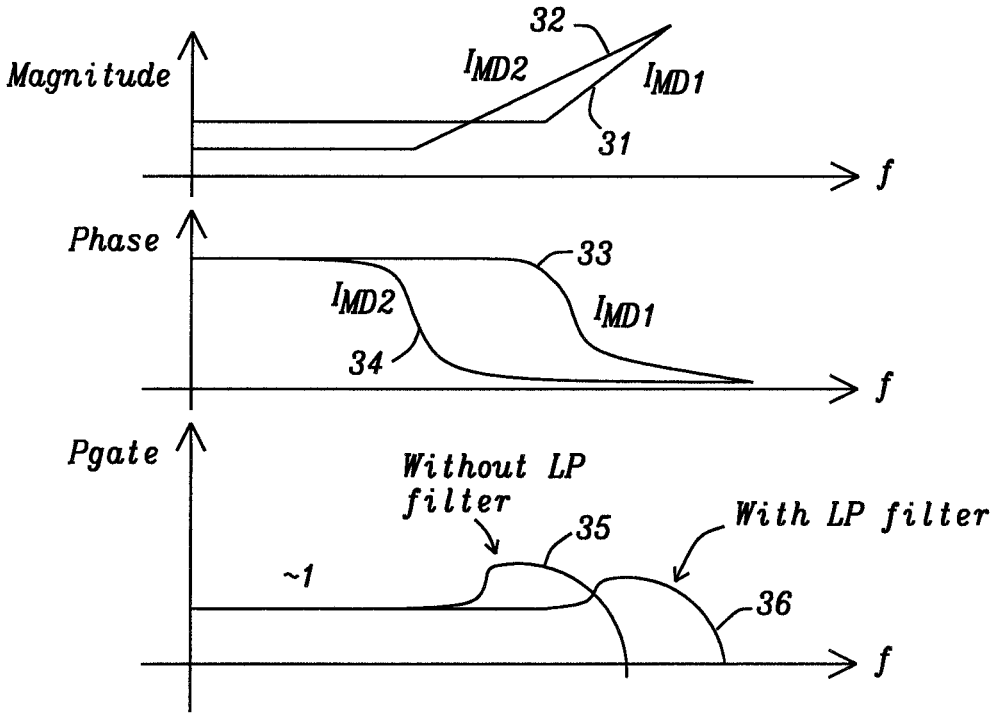
FIG. 3 shows diagrams of injection behavior across frequency according to the embodiment of FIG. 2.

FIG. 3 illustrates diagrams of injection behavior across frequency using the driver stage 210 incorporating the compensating circuit 215 according to the embodiment of FIG. 2: current magnitude (top), current phase (central) and driving voltage (bottom). Curves 31 and 32 of the top diagram show the current magnitude of the drive transistor $M_{D1}$ 211 and the further drive transistor $M_{D2}$ 213 over frequency, respectively. At low frequencies, the gate voltages of $M_{D1}$ 211 and $M_{D2}$ 213 do not change and therefore the currents resulting from the corresponding gate voltage $I_{MD1}$ and $I_{MD2}$ keep unchanged. Once the frequency reaches a certain value, e.g. the cut-off frequency of the LPF 214, the current magnitude of the further drive transistor $M_{D2}$ 213, $I_{MD2}$, starts to increase as the gate voltage of $M_{D2}$ 213 starts to decrease significantly at this frequency due to the LPF 214, as represented by curve 32. On the contrary, without the effect of the LPF 214, the current magnitude of the drive transistor $M_{D1}$ 211 starts to increase at a frequency higher than the cut-off frequency of the LPF 214, as represented by curve 31. Likewise, changes in current phase for $I_{MD1}$ and $I_{MD2}$ can also be observed at corresponding frequencies, as shown by curves 33 and 34 of the central diagram, respectively.

It is appreciated that the joint contribution of the drive transistor $M_{D1}$ 211 and the further drive transistor $M_{D2}$ 213 determines the driving voltage $P_{gate}$, which is shown by curves 35 and 36 of the bottom diagram. In fact, one can additionally apply the further drive transistor $M_{D2}$ 213 to compensate for the effect of $V_{gs}$ drops caused by the drive transistor $M_{D1}$ 211. In the diagram, the driving voltage $P_{gate}$ has been normalized by $V_{IN}$. By applying the compensating circuit 215 which comprises the further drive transistor $M_{D2}$ 213 and the LPF 214, the bandwidth for which the driving voltage $P_{gate}$ remains constant can be extended (from curve 35 to curve 36), thereby keeping the voltage difference between the gate/drive terminal of the pass device 109 and the supply voltage of the linear regulator $V_{IN}$, $V_{gs}$, constant across a large range of frequencies. Therefore, the compensating circuit 215 achieves bandwidth extension of constant $V_{gs}$, enabling the driver stage 210 ($P_{drive}$ stage) to drive the pass device 109 with a stable driving voltage and further improving the PSRR of the linear regulator.

Figure 4:
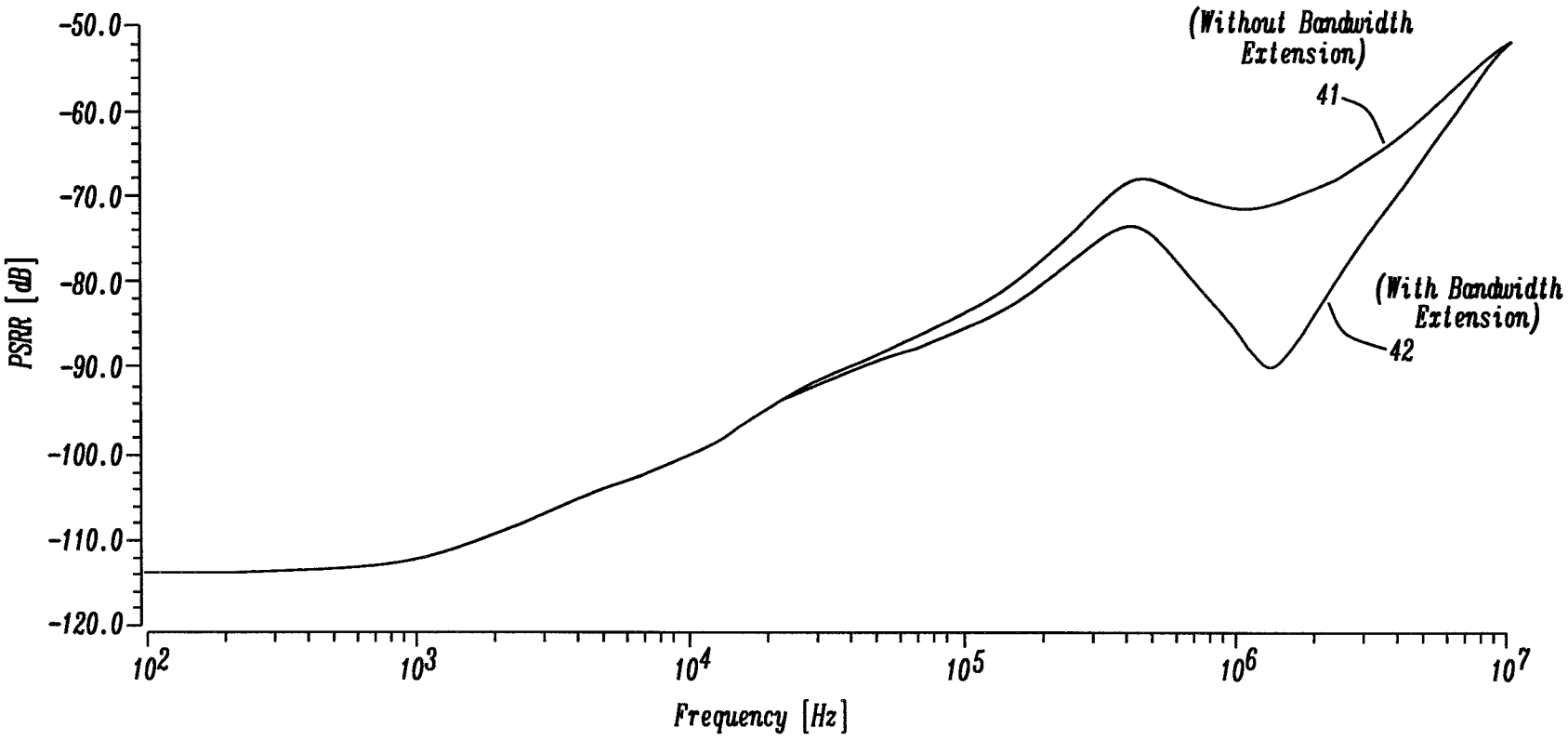
FIG. 4 shows a comparison of PSRR across frequency for the linear regulator without and with bandwidth extension according to the embodiment of FIG. 2.

FIG. 4 illustrates a comparison of PSRR across frequency for the linear regulator with and without applying the compensating circuit 215 to the driver stage 210 to achieve bandwidth extension of constant $V_{gs}$. Curve 41 represents the PSRR across frequency without bandwidth extension, while curve 42 represents the PSRR across frequency with bandwidth extension by applying the compensating circuit 215 to the driver stage 210. It is clearly shown that the PSRR is improved for frequencies above 400 kHz by applying the compensating circuit 215 to the driver stage 210 which achieves bandwidth extension of constant $V_{gs}$, indicating that signal injections caused by ripples at high frequencies have been reduced.

Thus, the change in a voltage difference between the drive terminal of the pass device and the supply voltage of the linear regulator can be compensated through the contribution of the further drive transistor in the compensating circuit. It is further appreciated that the frequency range at which the $V_{gs}$ of the pass device remains constant when injecting signal from $V_{IN}$ is extended by applying the compensating circuit which comprises the further drive transistor $M_{D2}$ and the LPF, thereby reducing the injections of this element at higher frequencies and improving PSRR. Higher frequencies are in particular frequencies above the cut-off frequency of the LPF.

According to the embodiment, PSRR improvement is extended to higher frequencies for a linear regulator with a P-type drive. It should be noted, however, that the present disclosure is applicable to linear regulators with a drive buffer stage in general and the proposed circuitry to compensate the AC injections and keep the $V_{gs}$ voltage constant across frequency can also be used for an N-type pass device for negative regulation.

It should also be noted that, although the above mentioned embodiment applies a compensation stage in the compensating circuit to the driver stage, the proposed technique can be extended to applying more stages of further drive transistors and LPFs coupled in parallel. More specifically, two or more compensation stages are applied to the driver stage, that is, the compensating circuit may comprise two or more further drive transistors and LPFs.

Figure 6A:
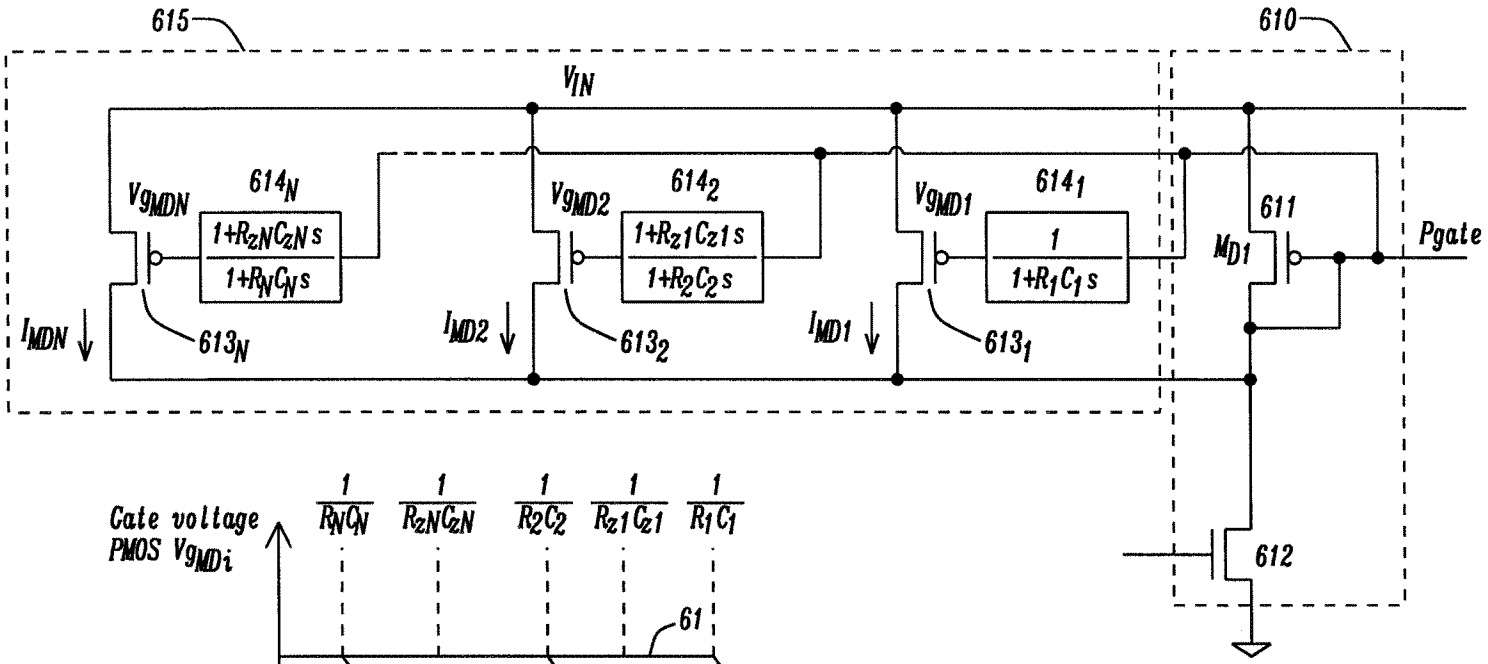
FIG. 6(*a*) shows a schematic implementation of an N-stage bandwidth extension circuitry according to another embodiment of the disclosure.
Figure 6B:
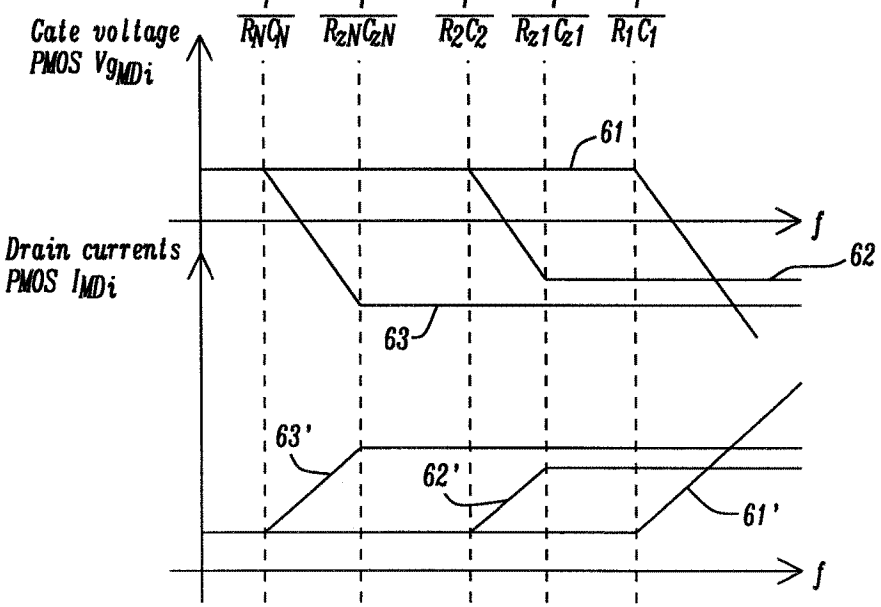

FIG. 6(*a*) shows a schematic implementation of an N-stage bandwidth extension circuitry for a driver stage of a linear regulator according to another embodiment of the disclosure. The linear regulator comprises a driver stage 610 which may be used for the same purpose as the driver stage 110 in FIG. 1 that is coupled with the PMOS pass device 109 having a first terminal coupled with the supply voltage of the linear regulator $V_{IN}$, a second terminal coupled with the output of the linear regulator 100 and a drive terminal which is the gate of the PMOS pass device. Similar to the driver stage 110, the driver stage 610 comprises a common source NMOS transistor 612 and a drive transistor $M_{D1}$ 611 that is a PMOS transistor in diode configuration. The driver stage 610 is coupled with the supply voltage of the linear regulator $V_{IN}$ and the drive terminal of the PMOS pass device 109 to drive the PMOS pass device 109. In the embodiment, the gate of drive transistor $M_{D1}$ 611 is connected with the gate of the PMOS pass device 109 and provides the driving voltage ($P_{gate}$) to drive the PMOS pass device 109. The drive transistor $M_{D1}$ 611 is thus in a current mirror configuration with the PMOS pass device 109 and this configuration can be regarded as a P-type drive for a linear regulator.

According to the embodiment, the linear regulator further comprises a compensating circuit 615 which consists of N further drive transistors $\mathbf{613}_1$, $\mathbf{613}_2$, . . . , $\mathbf{613}_N$ and N low-pass filters (LPFs) $\mathbf{614}_1$, $\mathbf{614}_2$, . . . , $\mathbf{614}_N$, where N is an arbitrary integer. In this configuration, the N further drive transistors $\mathbf{613}_1$, $\mathbf{613}_2$, . . . , $\mathbf{613}_N$ are also PMOS transistors and are arranged in parallel with the drive transistor $M_{D1}$ 611.

That is, the source of the drive transistor $M_{D1}$ 611 and the source of the N further drive transistors $\mathbf{613}_1$, $\mathbf{613}_2$, . . . , $\mathbf{613}_N$ are all coupled to the supply voltage of the linear regulator $V_{IN}$, while the drain of the drive transistor $M_{D1}$ 611 and the drain of the N further drive transistors $\mathbf{613}_1$, $\mathbf{613}_2$, . . . , $\mathbf{613}_N$ are all coupled to the common source NMOS transistor 612, e.g. to the source of the NMOS transistor 612.

Furthermore, each of the N LPFs $\mathbf{614}_1$, $\mathbf{614}_2$, . . . , $\mathbf{614}_N$ is coupled between the drive transistor $M_{D1}$ 611 and the corresponding further drive transistor $\mathbf{613}_1$, $\mathbf{613}_2$, . . . , $\mathbf{613}_N$. More specifically, the input of each of the LPF $\mathbf{614}_1$, $\mathbf{614}_2$, . . . , $\mathbf{614}_N$ is coupled to the gate of the drive transistor $M_{D1}$ 611 and the output of each of the LPF $\mathbf{614}_1$, $\mathbf{614}_2$, . . . , $\mathbf{614}_N$ is coupled to the gate of their corresponding further drive transistor $\mathbf{613}_1$, $\mathbf{613}_2$, . . . , $\mathbf{613}_N$.

In fact, the diode connected device of the drive transistor $M_D$ 111 of FIG. 1 is split into (N+1) parts, i.e. $M_{D1}$ 611 and the N further drive transistors $\mathbf{613}_1$, $\mathbf{613}_2$, . . . , $\mathbf{613}_N$, and the LPF $\mathbf{614}_1$, $\mathbf{614}_2$, . . . , $\mathbf{614}_N$ are placed to generate the gate voltages of the further drive transistors $\mathbf{613}_1$, $\mathbf{613}_2$, . . . , $\mathbf{613}_N$ from $M_{D1}$ 611. At low frequencies, voltages at the gate of the N further drive transistors $\mathbf{613}_1$, $\mathbf{613}_2$, . . . , $\mathbf{613}_N$ and $M_{D1}$ 611 may be the same and there is no effect caused by splitting the drive transistor $M_D$ 111 of FIG. 1 into $M_{D1}$ 611 and the N further drive transistors $\mathbf{613}_1$, $\mathbf{613}_2$, . . . , $\mathbf{613}_N$. When the cut-off frequency of the filter is hit, i.e. the frequency of the AC signals coupled into the input supply of the linear regulator $V_{IN}$ reaches the cut-off frequency of the filter, the gate voltages of the further drive transistors $\mathbf{613}_1$, $\mathbf{613}_2$, . . . , $\mathbf{613}_N$ may be attenuated, causing the injection of the further drive transistors $\mathbf{613}_1$, $\mathbf{613}_2$, . . . , $\mathbf{613}_N$ to be amplified over frequency (AC-wise) and phase to be shifted due to the filter. As a consequence, the contribution of currents resulting from different $V_{gs}$ across frequency, $I_{MD1}$, $I_{MD2}$, . . . , $I_{MDN}$ compensates for the effect caused by injections of $M_{D1}$ at higher frequencies, keeping the driving voltage $P_{gate}$ constant over frequency (AC wise) for a larger range of frequencies.

In the embodiment, the poles of the transfer function for the LPFs $\mathbf{614}_1$, $\mathbf{614}_2$, . . . , $\mathbf{614}_N$ have been set to $R_1C_1<R_2C_2< \ldots <R_NC_N$ to compensate AC injections at different frequencies. For the filters which have lower cut-off frequencies, such as for the filter stage $\mathbf{614}_i$ with larger i, it is necessary to also add a zero to the transfer function to limit the injection at higher frequencies in order to see the benefit of different stages at different frequencies. For example, $R_{zi}C_{zi}$ is chosen for the LPF stage $\mathbf{614}_i$ to limit the $V_{gs}$ drop of the low frequency stage at higher frequencies so as to avoid excessive injection from this stage, which is illustrated in the bottom diagram of FIG. 6(*b*).

FIG. 6(*b*) shows diagrams of gate voltage (top) and drain current (bottom) of the N further drive transistors $\mathbf{613}_1$, $\mathbf{613}_2$, . . . , $\mathbf{613}_N$ according to the embodiment of FIG. 6(*a*). Curve 61 represents the gate voltage $V_{gMD1}$ of the first further drive transistor $\mathbf{613}_1$, curve 62 represents the gate voltage $V_{gMD2}$ of the second further drive transistor $\mathbf{613}_2$ and curve 63 represents the gate voltage $V_{gMDN}$ of the N-th further drive transistor $\mathbf{613}_N$. Due to the lower cut-off frequency LPF stage $\mathbf{614}_i$ (where i is relative large) coupled to the gate, the gate voltage $V_{gMDi}$ of the corresponding further drive transistor $\mathbf{613}_i$ starts to decrease significantly at a lower frequency compared to that provided by the higher cut-off frequency LPF stage (i is smaller). On the contrary, the drain current Imp of the corresponding further drive transistor $\mathbf{613}_i$ produced by the lower cut-off frequency LPF stage starts to increase significantly at a lower frequency compared to that produced by the higher cut-off frequency LPF stage, as shown in the bottom diagram of FIG. 6(*b*), where curve 61' represents the drain current $I_{MD1}$ of the first further drive transistor $\mathbf{613}_1$, curve 62' represents the drain current $I_{MD2}$ of the second further drive transistor $\mathbf{613}_2$ and curve 63' represents the drain current $I_{MDN}$ of the N-th further drive transistor $\mathbf{613}_N$.

Figure 7:
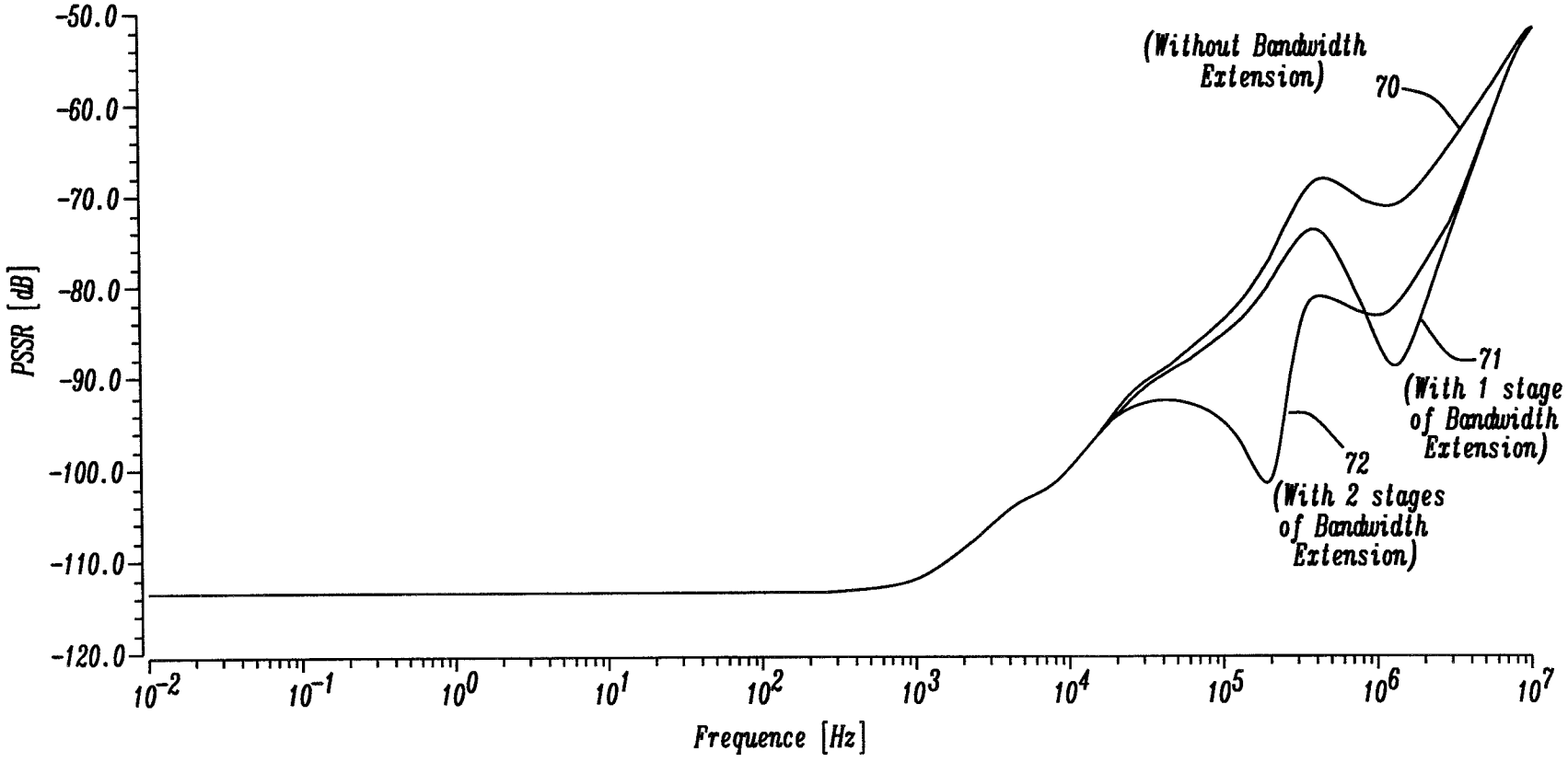
FIG. 7 shows a comparison of PSRR across frequency for the linear regulator without and with bandwidth extension according to the embodiment of FIG. 6.

FIG. 7 illustrates a comparison of PSRR across frequency for the linear regulator without (applying 0 compensation stage) and with bandwidth extension (applying 1 or 2 compensation stages to the driver stage 610) according to the embodiment of FIG. 6. For simplicity purposes, up to two compensation stages are applied to the driver stage 610 in this example, i.e. the compensating circuit 615 comprises up to two further drive transistors ($\mathbf{613}_1$, $\mathbf{613}_2$) and up to two LPFs ($\mathbf{614}_1$, $\mathbf{614}_2$), for compensating at two different frequencies. Curve 70 represents the PSRR across frequency without bandwidth extension, while curves 71 and 72 represent the PSRR across frequency with bandwidth extension by applying one and two compensation stages to the driver stage 610, respectively. One can see from the diagram that the PSRR can be improved by applying compensation stage(s) of the further drive transistors and LPFs to the driver stage 610. In particular, when two stages of the further drive transistors and LPFs are applied to the driver stage 610, two valleys can be observed, which corresponds to the two different cut-off frequencies of the two respective compensation stages. In general, it should be noted that a number of compensation stage N may correspond to a number of LPF cut-off frequencies at which the change in the voltage difference between the drive terminal of the pass device and the supply voltage of the linear regulator is compensated.

Thus, the proposed circuitry for linear regulators improves the PSRR (in particular at high load currents) by extending the frequency range for which the $V_{gs}$ of the pass device remains constant. It is appreciated that PSRR degradation can be mitigated at specific frequencies, in particular at the higher frequency range, by compensating the voltage difference between the drive terminal of the pass device and the supply voltage of the linear regulator with the above mentioned compensating circuit, thereby providing linear regulators with high PSRR while keeping low quiescent current consumption.

According to the embodiment, PSRR improvement is extended to higher frequencies for a linear regulator with a P-type drive. It should be noted, however, that the present disclosure is applicable to linear regulators with a drive buffer stage in general and the proposed circuitry to compensate the AC injections and keep the $V_{gs}$ voltage constant across frequency can also be used for an N-type pass device for negative regulation.

Figure 5:
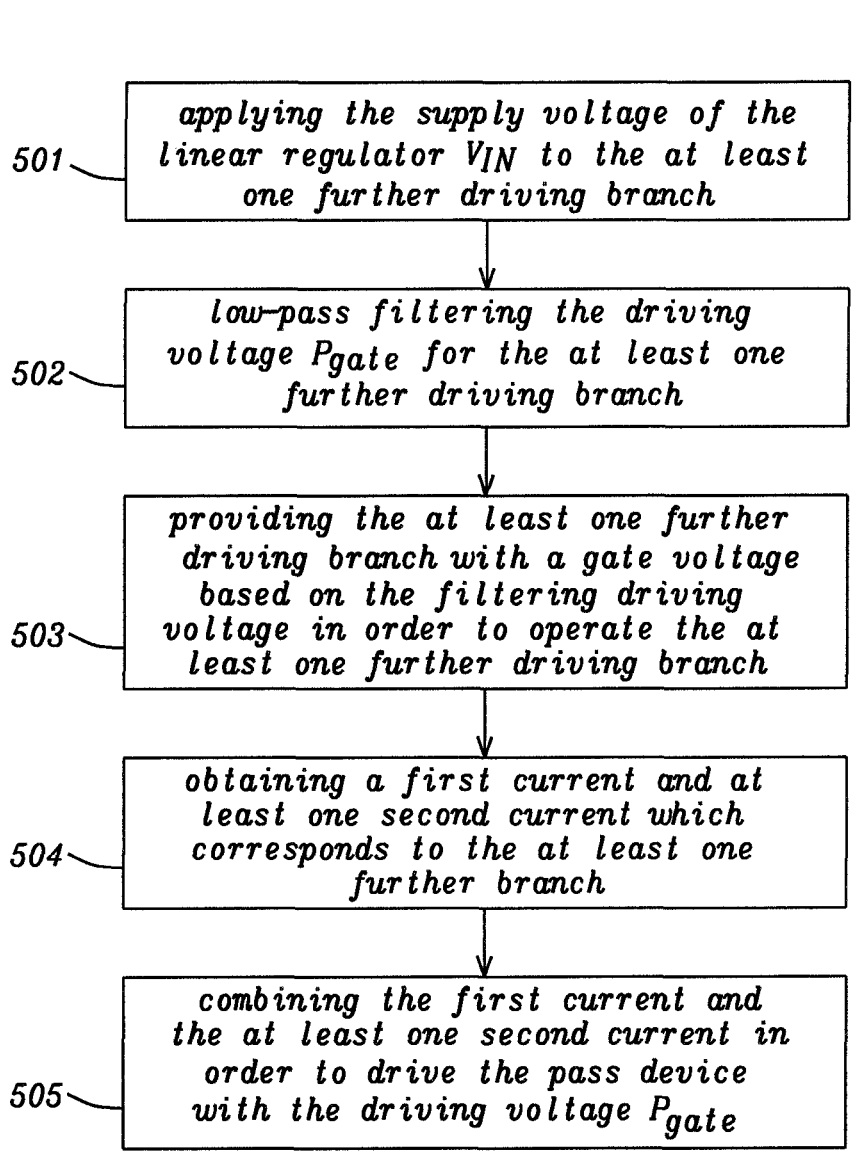
FIG. 5 shows a flow diagram of an example method for operating a linear regulator according to the embodiments.

FIG. 5 shows a flow diagram of an example method 500 for operating a linear regulator according to the embodiments. The linear regulator is configured as disclosed above and comprises a pass device 109 and a driver stage 210, 610. The driver stage 210, 610 comprises a driving branch and the driving branch is configured to drive the pass device 109 with a driving voltage $P_{gate}$ through a drive terminal. The linear regulator further comprises at least one further driving branch. The method 500 comprises the step of applying 501 the supply voltage of the linear regulator $V_{IN}$ to the at least one further driving branch. Furthermore, the method 500 comprises low-pass filtering 502 the driving voltage $P_{gate}$ for the at least one further driving branch. As mentioned above, low-pass filtering the driving voltage $P_{gate}$ may be based on a transfer function with poles. In some embodiments where filter stages with lower cut-off frequencies are applied, low-pass filtering the driving voltage $P_{gate}$ may be based on a transfer function with poles and zeros to improve performance of the $V_{gs}$ drop compensation at high frequencies. The method 500 further comprises providing 503 the at least one further driving branch with a gate voltage based on the filtered driving voltage in order to operate the at least one further driving branch.

Furthermore, the method comprises obtaining 504 a first current and at least one second current which corresponds to the at least one further branch. The first current is provided by the driving branch, and the at least one second current is provided by the corresponding further driving branch. The method further comprises combining 505 the first current and the at least one second current in order to drive the pass device 109 with the driving voltage $P_{gate}$.

As such, through the joint contribution of the driving branch and the at least one further driving branch, the change in a voltage difference between the drive terminal of the pass device and the supply voltage of the linear regulator caused by injected ripples of high frequencies can be compensated. It is appreciated that the voltage difference between the drive terminal of the pass device and the supply voltage of the linear regulator $V_{gs}$ remains constant in the presence of injected ripples for a larger range of frequencies, so that the impact of injected ripples can be reduced and PSRR of the linear regulator can be improved.

In the present disclosure, a linear regulator applying compensation stages to a driver stage thereof and a corresponding method to extend the bandwidth of improved PSRR have been described. In particular, the AC injections can be compensated by the proposed compensating circuit and the voltage difference between the drive terminal and the supply voltage of the linear regulator $V_{gs}$ remains constant across frequency. Hence, PSRR can be improved at higher frequencies, reducing the impact of the noise injected in the input supply voltage of the linear regulator.

It should be noted that the description and drawings merely illustrate the principles of the proposed methods and systems. Those skilled in the art will be able to implement various arrangements that, although not explicitly described or shown herein, embody the principles of the invention and are included within its spirit and scope.

Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A linear regulator comprising: a pass device having a first terminal, a second terminal and a drive terminal, the first terminal of the pass device coupled with the supply voltage of the linear regulator, the second terminal of the pass device coupled with the output of the linear regulator; a driver stage coupled with the supply voltage of the linear regulator and the drive terminal of the pass device to drive the pass device with a driving voltage; and a compensating circuit configured to compensate for a change in a voltage difference between the drive terminal of the pass device and the supply voltage of the linear regulator; wherein the driver stage comprises a drive transistor, the compensating circuit comprises at least one further drive transistor, a. wherein the drive transistor of the driver stage is in a current mirror configuration with the pass device; b. wherein the drive transistor of the driver stage is arranged in parallel with the at least one further drive transistor of the compensating circuit; wherein the compensating circuit further comprises at least one low-pass filter (LPF) coupled between the drive transistor and the at least one further drive transistor, wherein the at least one LPF corresponds to the at least one further drive transistor; and wherein the driver stage further comprises a first transistor, each of the drive transistor and the at least one further drive transistor further comprising a second terminal, wherein the second terminal of each of the drive transistor and the at least one further drive transistor is directly coupled with the first transistor.

2. The linear regulator of claim 1, wherein:

a. each of the drive transistor and the at least one further drive transistor comprises a first terminal and a drive terminal;

b. the first terminal of each of the drive transistor and the at least one further drive transistor is coupled with the supply voltage of the linear regulator; and c. the drive terminal of the drive transistor is coupled with the drive terminal of the pass device, the drive terminal of the drive transistor providing the driving voltage to drive the pass device.

3. The linear regulator of claim 2, wherein each of the at least one LPF comprises an input and an output, the input of each LPF coupled to the drive terminal of the drive transistor, the output of each LPF coupled to the drive terminal of the corresponding further drive transistor.

4. The linear regulator of claim 1, wherein the at least one LPF has a transfer function with poles.

5. The linear regulator of claim 1, wherein some of the at least one LPF have a transfer function with poles and zeros.

6. The linear regulator of claim 1, wherein the compensating circuit comprises N low-pass filters (LPFs) and N further drive transistors, where N is an arbitrary integer.

7. The linear regulator of claim 6, wherein N corresponds to a number of LPF cut-off frequencies at which the change in the voltage difference between the drive terminal of the pass device and the supply voltage of the linear regulator is compensated.

8. The linear regulator of claim 1 wherein: a. the first transistor comprises an NMOS transistor; b. the drive transistor comprises a PMOS transistor, the first terminal of the drive transistor comprising a source terminal of the PMOS transistor, the drive terminal of the drive transistor comprising a gate terminal of the PMOS transistor; c. the at least one further drive transistor comprises at least one further PMOS transistor, the first terminal of the at least one further drive transistor comprising a source terminal of the at least one further PMOS transistor, the drive terminal of the at least one further drive transistor comprising a gate terminal of the at least one further PMOS transistor; and d. the voltage difference between the drive terminal of the pass device and the supply voltage of the linear regulator is associated with a voltage difference between the gate and the source terminal of the PMOS transistor of the driver stage.

9. The linear regulator of claim 1, wherein the pass device comprises a PMOS transistor.

10. The linear regulator of claim 1, further comprising:

a. a first amplifier stage;

b. a second amplifier stage coupled between the first amplifier stage and the driver stage; and c. a capacitor coupled between the first amplifier stage and the output of the linear regulator.

11. The linear regulator of claim 1, wherein the driver stage comprises a buffer stage.

12. A method of providing a linear regulator comprising the steps of: providing a pass device having a first terminal, a second terminal and a drive terminal, the first terminal of the pass device coupled with the supply voltage of the linear regulator, the second terminal of the pass device coupled with the output of the linear regulator; providing a driver stage coupled with the supply voltage of the linear regulator and the drive terminal of the pass device to drive the pass device with a driving voltage; and providing a compensating circuit to compensate for a change in a voltage difference between the drive terminal of the pass device and the supply voltage of the linear regulator; wherein the driver stage comprises a drive transistor, the compensating circuit comprises at least one further drive transistor, a. wherein the drive transistor of the driver stage is in a current mirror configuration with the pass device; b. wherein the drive transistor of the driver stage is arranged in parallel with the at least one further drive transistor of the compensating circuit, and wherein the compensating circuit further comprises at least one low-pass filter (LPF) coupled between the drive transistor and the at least one further drive transistor, wherein the at least one LPF corresponds to the at least one further drive transistor; and wherein the driver stage further comprises a first transistor, each of the drive transistor and the at least one further drive transistor further comprising a second terminal, wherein the second terminal of each of the drive transistor and the at least one further drive transistor is directly coupled with the first transistor.

13. The method of claim 12, wherein:

a. each of the drive transistor and the at least one further drive transistor comprises a first terminal and a drive terminal;

b. the first terminal of each of the drive transistor and the at least one further drive transistor is coupled with the supply voltage of the linear regulator; and c. the drive terminal of the drive transistor is coupled with the drive terminal of the pass device, the drive terminal of the drive transistor providing the driving voltage to drive the pass device.

14. The method of claim 13, wherein each of the at least one LPF comprises an input and an output, the input of each LPF coupled to the drive terminal of the drive transistor, the output of each LPF coupled to the drive terminal of the corresponding further drive transistor.

15. The method of claim 12, wherein the at least one LPF has a transfer function with poles.

16. The method of claim 12, wherein some of the at least one LPF have a transfer function with poles and zeros.

17. The method of claim 12, wherein the compensating circuit comprises N low-pass filters (LPFs) and N further drive transistors, where N is an arbitrary integer.

18. The method of claim 17, wherein N corresponds to a number of LPF cut-off frequencies at which the change in the voltage difference between the drive terminal of the pass device and the supply voltage of the linear regulator is compensated.

19. The method of claim 12, wherein: a. the first transistor comprises an NMOS transistor; b. the drive transistor comprises a PMOS transistor, the first terminal of the drive transistor comprising a source terminal of the PMOS transistor, the drive terminal of the drive transistor comprising a gate terminal of the PMOS transistor; c. the at least one further drive transistor comprises at least one further PMOS transistor, the first terminal of the at least one further drive transistor comprising a source terminal of the at least one further PMOS transistor, the drive terminal of the at least one further drive transistor comprising a gate terminal of the at least one further PMOS transistor; and d. the voltage difference between the drive terminal of the pass device and the supply voltage of the linear regulator is associated with a voltage difference between the gate and the source terminal of the PMOS transistor of the driver stage.

20. The method of claim 12, wherein the pass device comprises a PMOS transistor.

21. The method of claim 12, further comprising the steps of:

a. providing a first amplifier stage;

b. providing a second amplifier stage coupled between the first amplifier stage and the driver stage; and c. providing a capacitor coupled between the first amplifier stage and the output of the linear regulator.

22. The method of claim 12, wherein the driver stage comprises a buffer stage.

* * * * *